US008584914B1

(12) United States Patent
Bryce

(10) Patent No.: US 8,584,914 B1
(45) Date of Patent: Nov. 19, 2013

(54) METHOD AND APPARATUS FOR TRANSPORTING A PERSON ON THE BACK OF ANOTHER PERSON

(75) Inventor: Jeff Bryce, Albuquerque, NM (US)

(73) Assignee: Piggybackpack, LLC., Albuquerque, NM (US)

( * ) Notice: Subject to any disclaimer, the term of this patent is extended or adjusted under 35 U.S.C. 154(b) by 0 days.

(21) Appl. No.: 13/299,928

(22) Filed: Nov. 18, 2011

Related U.S. Application Data

(60) Provisional application No. 61/458,544, filed on Nov. 27, 2010.

(51) Int. Cl.
*A47D 13/02* (2006.01)
*A61G 1/00* (2006.01)

(52) U.S. Cl.
USPC ..... 224/161; 224/160

(58) Field of Classification Search
USPC ..... 224/637, 158–161, 155, 638, 645
See application file for complete search history.

(56) References Cited

U.S. PATENT DOCUMENTS 4,993,612 A * 2/1991 Quimby et al. ..... 224/160
5,609,279 A * 3/1997 O'Shea ..... 224/160
5,868,292 A * 2/1999 Stephens et al. ..... 224/161
6,098,856 A * 8/2000 Reilly ..... 224/160
6,186,381 B1 2/2001 Kernkamp
6,345,745 B1 * 2/2002 Harriss ..... 224/158
8,056,779 B1 * 11/2011 Brunwin ..... 224/160
2003/0034372 A1 * 2/2003 Thompson et al. ..... 224/637

OTHER PUBLICATIONS http://www.thepiqgybackrider.com/piggyback/piggyback.php, Sep. 10, 2010.
http://www.childcarriers.com/category/baby-backpacks/, Nov. 15, 2011.
http://www.products.howstuffworks.com/baby-backpack-carriers-types.htm, Nov. 15, 2011.

* cited by examiner

*Primary Examiner* — Nathan J Newhouse
*Assistant Examiner* — Corey Skurdal
(74) *Attorney, Agent, or Firm* — Deborah A. Peacock; Justin R. Jackson; Peacock Myers, P.C.

(57) ABSTRACT

A method and apparatus for transporting a person on the back of another person, wherein at least a majority of the weight of the rider is placed upon the carrier's hips and not the shoulders and/or back of the carrier. A harness formed from a plurality of straps is worn by a carrier and a rider stands and/or sits on a portion of the present invention.

14 Claims, 12 Drawing Sheets

METHOD AND APPARATUS FOR TRANSPORTING A PERSON ON THE BACK OF ANOTHER PERSON

CROSS-REFERENCE TO RELATED APPLICATIONS

This application claims priority to and the benefit of the filing of U.S. Provisional Patent Application Ser. No. 61/458,544, entitled "PiggyBackPack Child Carrier", filed on Nov. 27, 2010, and the specification and claims thereof are incorporated herein by reference.

BACKGROUND OF THE INVENTION

1. Field of the Invention (Technical Field)

Embodiments of the present invention relate to a method and apparatus for transporting a person. More particularly, embodiments of the present invention relate to a method and apparatus for transporting a smaller person, such as a child, on the back of a comparatively larger person. Embodiments of the present invention also relate to method, apparatus, and system for a carrier that can be worn by a person to carry another person on their back and more particularly to transfer the weight through a rigid frame to the wearer's hips to take the load off the spine.

2. Description of Related Art

There are many baby carriers that are good for carrying small children. However, a common problem among them is that as infants and toddlers outgrow the baby carriers, they have to walk for themselves or be carried by a parent. The parent's arms, backs and shoulders get tired and sore from carrying such toddlers, particularly on vacations that require a lot of walking, for example while attending a zoo, aquarium, or museum. Strollers are often big and often not capable of being used in confined and/or crowded areas, or over rough and elevated terrain or at locations having a lot of stairs. Because many situations are not suited well for strollers and because parents do not have unlimited time, they often choose to carry their children. Heavier children are often carried on a parent's back or shoulders. This load stresses the spine and parents often get sore backs from this arrangement.

Firemen are trained to carry a person using the fireman's carry. This is uncomfortable for the person being carried. It also compresses the fireman's spine and requires the fireman's arms and hands to hold onto the person being carried.

There is thus a present need for a method, apparatus, and system which can be used with toddlers and children and which allows hikers to get back on the trails so that both parent and child get a good workout and cover distances that are unachievable using a conventional stroller device. There is a further a need for a method, apparatus, and system which allows parents the flexibility to carry their child during daily activities when their child tires and can no longer keep up and which leaves the parents' hands free to handle and/or manipulate objects instead of having to be used only to hold and carry a toddler. Or help to hold the toddler on the parent's back and/or shoulders. There is further a need for a carrier that allows a fireman or rescue person to carry a heavy person farther, more easily and more comfortably.

BRIEF SUMMARY OF EMBODIMENTS OF THE PRESENT INVENTION

An embodiment of the present invention relates to a human transport apparatus having at least one shoulder strap; at least one waistband which is positionable on top of a carrier's hips, and an at least substantially rigid frame, the frame and waistband configured such that at least a majority of weight of a rider is distributed about hips of the carrier and not on one or more shoulders of the carrier. The human transport apparatus can also optionally comprise a rider seat, a back rest, one or more rider stirrups, one or more rider handles, one or more pockets, one or more storage compartments, one or more rider retaining straps, and/or one or more chest straps. Optionally, the transport apparatus can include padding, which can be disposed on and/or in the waistband, on and/or in one or more shoulder straps, and/or on and/or in one or more chest straps.

In one embodiment, the transport apparatus can also include an at least substantially rigid support, which can optionally be located on and/or in the waistband. Optionally, the transport apparatus can include one or more disassembly points, which can optionally be formed from one or more carabineers, clips, clamps, and/or combinations thereof.

The transport apparatus can also optionally include a seat post which can be removably positionable with respect to the at least substantially rigid frame.

An embodiment of the present invention also relates to a human transport apparatus which includes at least one chest strap; at least one waistband which is positionable on top of a carrier's hips; and an at least substantially rigid frame, the frame and waistband configured such that at least a majority of weight of a rider is distributed about hips of the carrier.

An embodiment of the present invention also relates to a human transport apparatus that includes at least one shoulder strap, at least one waistband which is positionable on top of a carrier's hips, and an at least substantially rigid frame, the frame and waistband configured such that at least a majority of weight of a rider is distributed about hips of the carrier.

An embodiment of the present invention also relates to a human transport method which includes a carrier donning a user-transport apparatus having a seat, a rider being positioned onto the apparatus and sitting on the seat, and at least a majority of the weight of the rider being distributed about hips of the carrier and not a spine of the carrier. Optionally, the rider can be positioned onto the apparatus by climbing onto the apparatus.

Embodiments of the present invention allows hikers to get back on the trails with both parent and child getting a good workout and covering distances that were unachievable before. It also allows for rescue transport of injured or disabled persons.

The backpack consists of a padded waistband, rigid frame, chest strap, shoulder straps and a seat, including but not limited to a noseless bicycle seat. In one embodiment, the frame that supports the seat extends up the torso to the shoulder blades where it is captured by a chest strap. The chest strap can hold the top of the frame against the wearer to keep the seat from rotating backwards. This allows for the shoulder straps to be worn loosely and the load transferred to the hips and legs of the wearer. Baby and toddler backpacks typically require the wearer to take the pack off to put the child in or take them out. Embodiments of the present invention provide the carrier with the ability to go down on one knee to let the rider quickly load and/or unload, optionally in as little as about two seconds. This is particularly useful as children frequently want to change from riding to walking and back to riding.

The frame is preferably strong and can hold hundreds of pounds. If the wearer is strong enough, they can carry a rider weighing hundreds of pounds. This can be very useful in rescue situations and/or transporting the mobility impaired, such as for example those encountered by search and rescue groups, emergency preparedness groups, firemen and the military.

Embodiments of the present invention are preferably compact when fully assembled and even more compact when disassembled, thus permitting the invention to be stowed beneath an airplane seat, under his or her feet on an amusement park ride or in a corner of a vehicle.

Embodiments of the present invention also optionally include stirrups and handles to make the ride more comfortable and secure for the rider. The waistband can optionally contain a pocket and a drink holder and there can be a bag disposed beneath the seat, which allows the wearer to carry extra items. Optionally, a back rest and/or seat belt can be provided, which can be useful to better secure the rider. The shoulder straps, if provided, can be worn vertically or they can be crossed to best accommodate the wearer. When an adult travels with a child, the pair can travel farther and faster than without the pack. When the child tires, he or she can quickly climb aboard and when the adult tires, the child can quickly dismount. Both can get a great workout and when the child reaches exhaustion, they can wrap their arms around the parent for a ride home instead of having a meltdown.

If the carrier is carrying an additional daypack, it can be worn on the front when a rider is on and can be worn on the back and supported on the seat to transfer the load to the hips when the rider is off.

The seat can be replaced with a platform or sling to carry nonhuman objects such as boxes of gear, food or be used to transfer the load to the hips for frameless packs. A multiple person team with multiple packs can be used to lifting and move a heavy non-human load, such as to pick up an air conditioner and carry it across the top of a building to eliminate the need for a crane. In this embodiment, the workers can carry the load with their legs instead of lifting with their arms and thereby avoiding loading their backs.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Embodiments of the present invention permit toddlers and children, to ride on the back of a parent, such that the riders weight is primarily transferred to the carriers hips, waist and legs and which makes it easy for the rider to get on and off the seat.

As used throughout this application, the terms "toddler" "rider" and/or "child", whether in the singular or the plural, is intended to include any human being that is larger than an infant or a baby and is comparatively smaller than the adult who is carrying them. Accordingly, such terms are not limited to a particular age range of a human. As used throughout this application, the terms "carrier" "adult" and/or "parent", whether in the singular or plural, is intended to include any human being that is comparatively larger than a rider and is typically intended to mean the person whom is transporting the rider.

Figure 1:
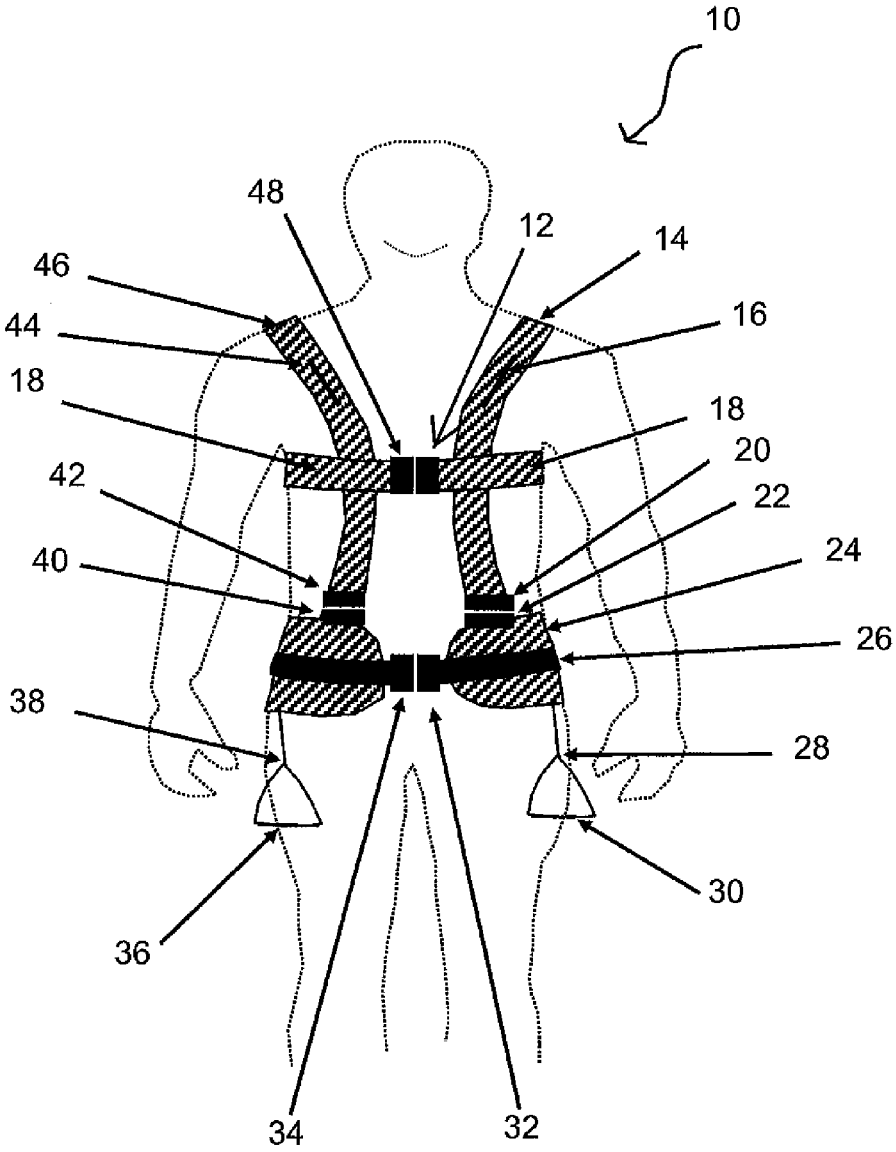
FIG. 1 is a drawing which illustrates a front view of a carrier according to an embodiment of the present invention which is disposed on a person.
Figure 2:
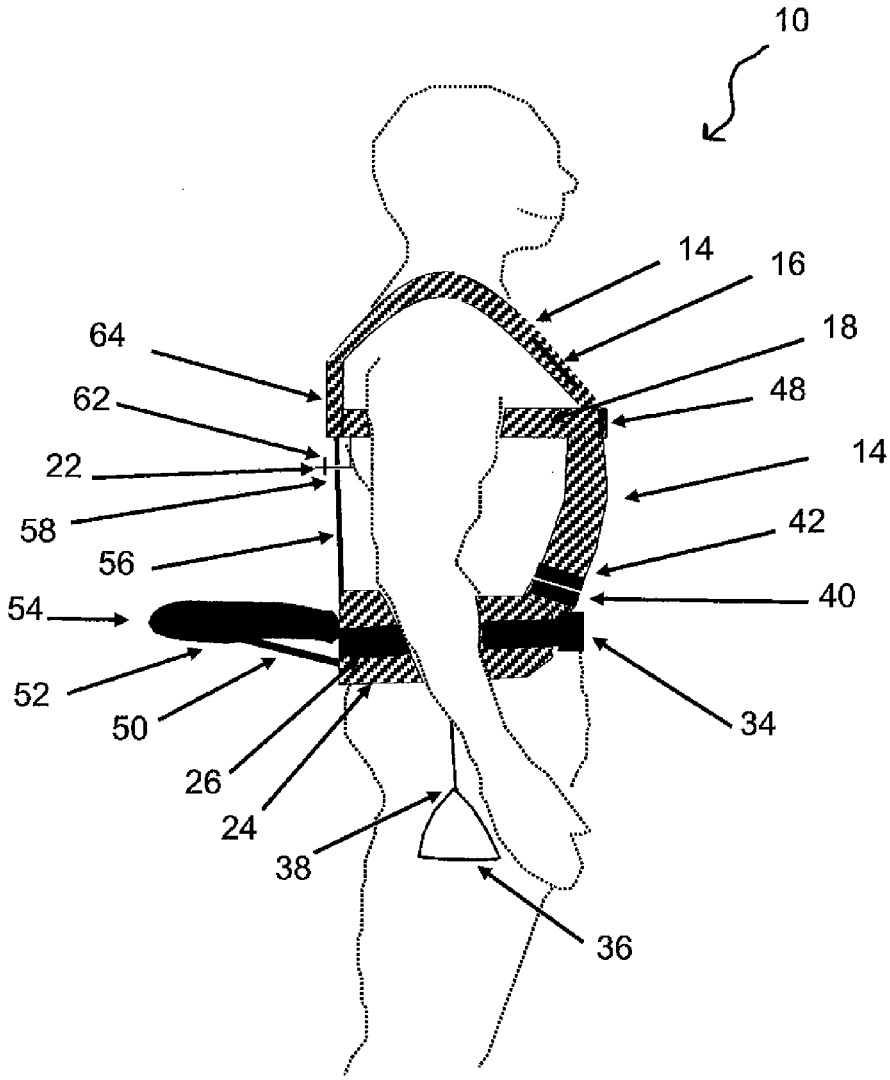
FIG. 2 is a drawing which illustrates a right side view of a carrier according to an embodiment of the present invention which is disposed on a person.
Figure 3:
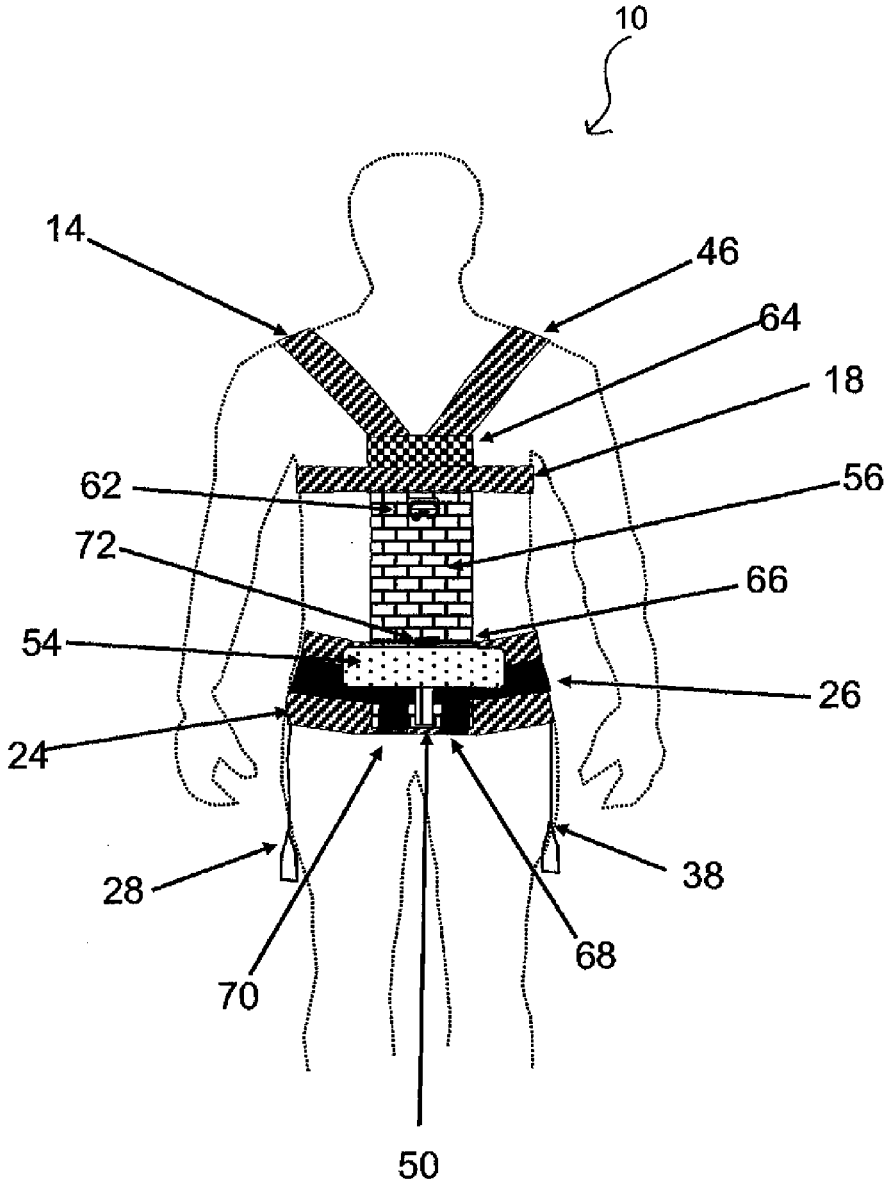
FIG. 3 is a drawing which illustrates a rear view of a carrier according to an embodiment of the present invention which is disposed on a person.

FIGS. 1, 2 and 3 illustrate an embodiment of carrying apparatus 10, which preferably includes waistband 24 with waist strap 26 and fasteners 32 and 34. Frames 56 and seat post 50 most preferably at least substantially rigid and attach to waistband 24

Straps 68 and 70 are preferably each folded over to form a pocket which holds a bottom portion of frame 56. Seat post 50 is preferably attached to frame 56, most preferably via welding, or some other secure method apparatus and/or system for attachment, and becomes trapped under waist strap 26. Strap 66 preferably wraps around frame 56 to secure the frame to the top of waistband 24. Hook and loop tape, or some other removably-positionable attachment mechanism 72 preferably comprises strap 66, which connects frame 56 to central section 88 of waistband reinforcing 85 by passing through one or more holes 89 (See FIG. 7).

Frame 56 and seat post 50 are preferably removable by spreading apart straps 68 and 70 at a lower portion thereof.

Because frame 56 and seat post 50 are preferably rigid, it transfers an applied load to the hips and legs of the person wearing the pack, i.e. the carrier. This prevents the load from excessively weighing on the shoulders and thus loading the carrier's spine. Chest strap 18 and/or shoulder straps 14 and 46 preferably attach fabric pocket 64 to frame 56. Fabric pocket 64 makes it easy to assemble and disassemble the system. Carabineer 62 or another fastener, is preferably used to pin strap 58 through hole 60 to lock fabric pocket 64 onto the top of frame 56. Chest strap 18 preferably keeps the top of frame 56 snugly against the carrier to keep the load on the seat from rotating and/or falling and by cantilevering too far away from the carrier. Fasteners 20, 22, 40 and 42 attach the shoulder straps to the waistband. Fasteners 12 and 48 fasten the ends of chest strap 18 together. Seat 54 with post clamp 52 is preferably attached to post 50.

The carrying apparatus 10 is preferably compact when fully assembled and even more compact when disassembled. It is convenient for situations when strollers and wheelchairs have limited access such as amusement parks, airports, escalators and stairs. An advantage of apparatus 10 is that it is easy for a rider to get on and off of it. Whether the carrier is hiking with a child that wants to get on and off often or carrying an injured person out of a burning building, apparatus 10 is easy to use. Stirrups 28 and 38 make the ride more comfortable for both rider and carrier. Stiffeners 30 and 36 preferably keep the stirrups open so that it is easier for the rider to put his or her feet in. The rider can optionally stand up in the stirrups to view over crowds or other low-lying obstacles that would otherwise obstruct his or her view from a less elevated position. Straps 16 and 44 are handles for the rider to hold onto.

Figure 4:
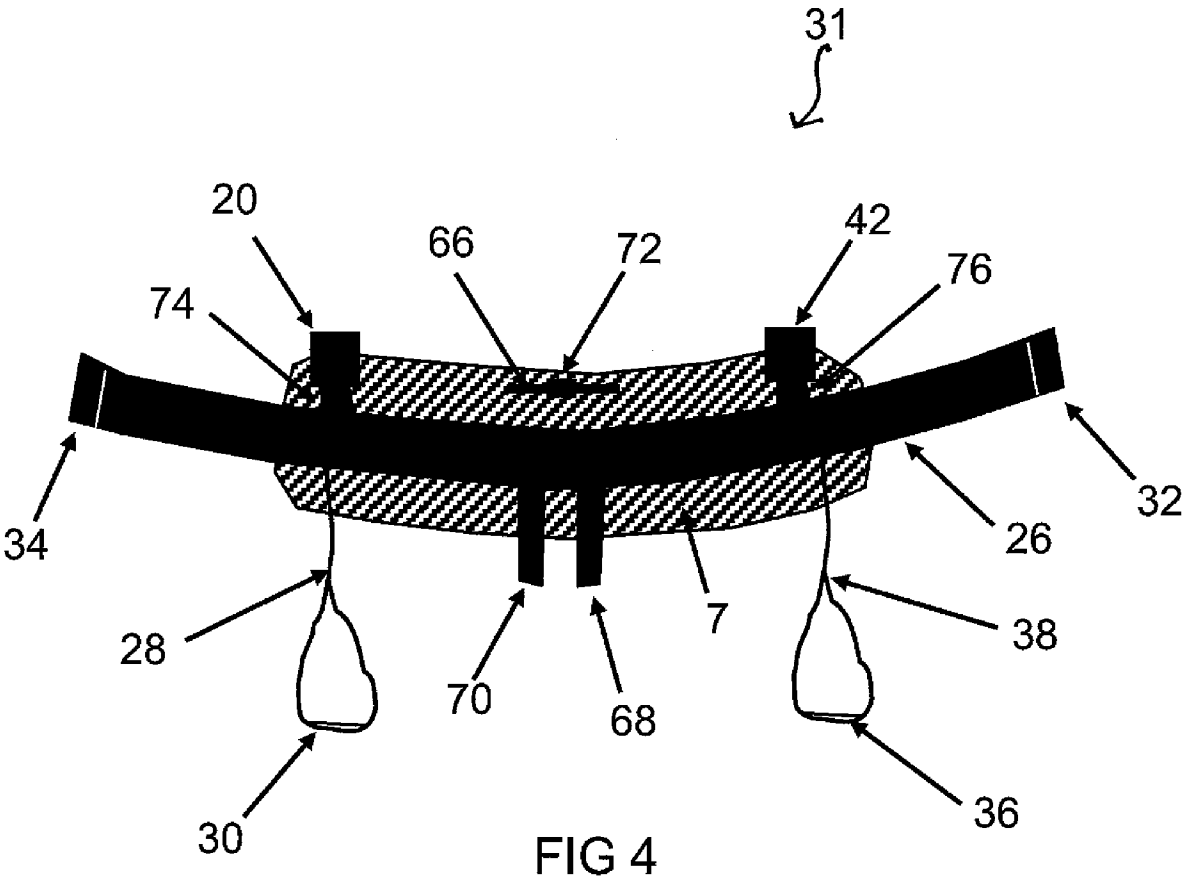
FIG. 4 is a drawing which illustrates a rear view of the waistband according to an embodiment of the present invention.

FIG. 4 illustrates an example of waistband assembly 31 of carrying apparatus 10. It preferably includes waist strap 26, which can optionally be a polymeric webbed material, including but not limited to nylon, polypropylene and/or polyester webbing having a width of from about ¾" to about 3" and most preferably about 2" in width. Straps 68, 70, 74, 76, 28, 38, and 66 are also optionally formed from a polymeric webbed material, including but not limited to nylon, polypropylene and/or polyester webbing and most preferably comprise a width which is less than that selected for waist strap 26. For example, straps 68, 70, 74, 76, 28, 38, and 66 can optionally have a width of from about ⅜" in to about 2" and most preferably from about ¾" to about 1" in width. Fabric 24 is preferably formed from a durable and water-resistant material and is most preferably formed from 1620 denier nylon. Fasteners 20, 32, 34 and 42 are preferably adjustably-positionable and formed form a durable material and are most preferably buckles, which are formed from acetal. Stiffeners 30 and 36 can optionally be formed from cord, and are most preferably formed from nylon cord which has a diameter of about ⅛". Heavy weight nylon thread, or another strong and durable thread is preferably used to sew the fabric and straps together.

Figure 5B:
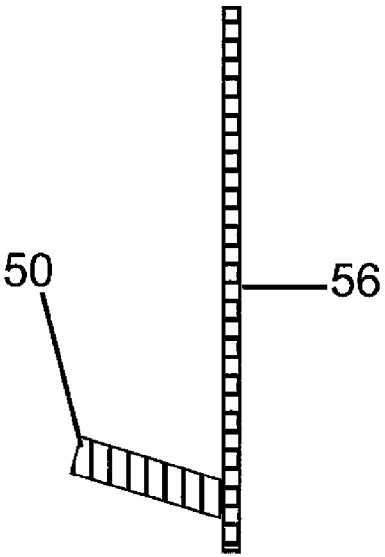
FIGS. 5A and B are drawings which respectively illustrate back and side views of a frame of a carrier according to an embodiment of the present invention.
Figure 5A:
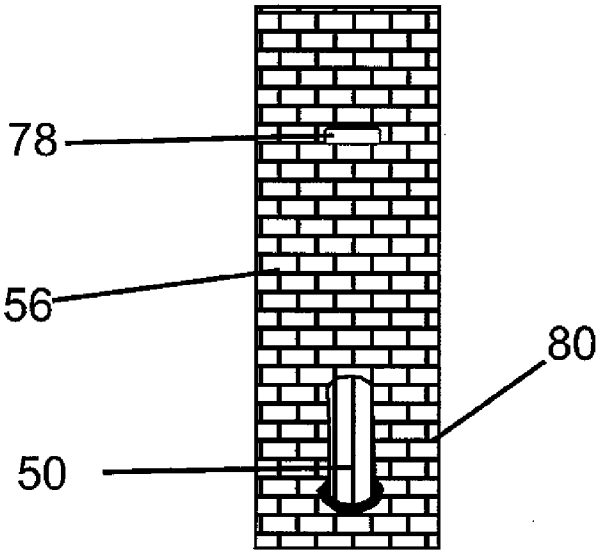

FIGS. 5A and 5B illustrate an embodiment of frame 56 which can be formed from a rigid and/or substantially rigid material, including but not limited to a metal, a plastic, a composite, a combination thereof and the like. Most preferably, frame 56 is formed from an aluminum material, such as T6061. Frame 56 preferably includes a rigid and/or semi-rigid rod and/or tube, including but not limited to an aluminum rod or tube. Seat post 50 may be attached via a weld and/or fastener 80 to frame 56. Frame 56 can be made to various dimensions, depending in part upon a predetermined size range of an intended carrier and rider and can optionally comprise a thickness of about 3/16" and a width of about 4" and a height of about 15". In addition, seat post 50 can have a diameter of about 0.875". The height of frame 56 can be determined, at least partially, by the preference that it extend to the shoulder blades of the carrier. This allows chest strap 18 to be worn high and encircle the wearer and frame 56. Frame 56 is preferably wide enough to minimize rocking from side to side, yet still be compact. The thickness used for frame 56 is preferably selected such that it provides high strength, while minimizing weight. Seat post 50 preferably comprises dimensions and a shape which permits it to be held in place of a seat on a typical bicycle.

Figure 6:
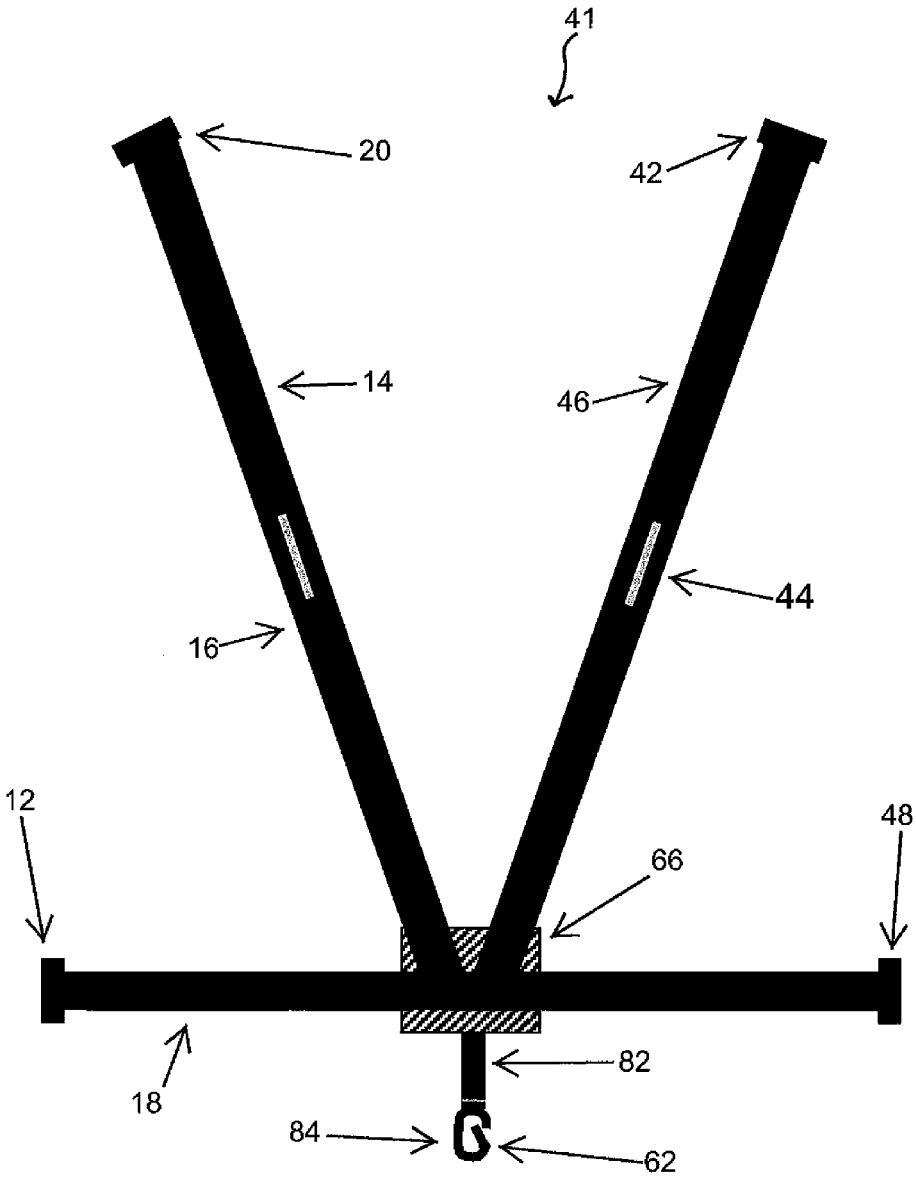
FIG. 6 is a drawing which illustrates a rear view of the chest and shoulder straps of a carrier according to an embodiment of the present invention.
Figure 8:
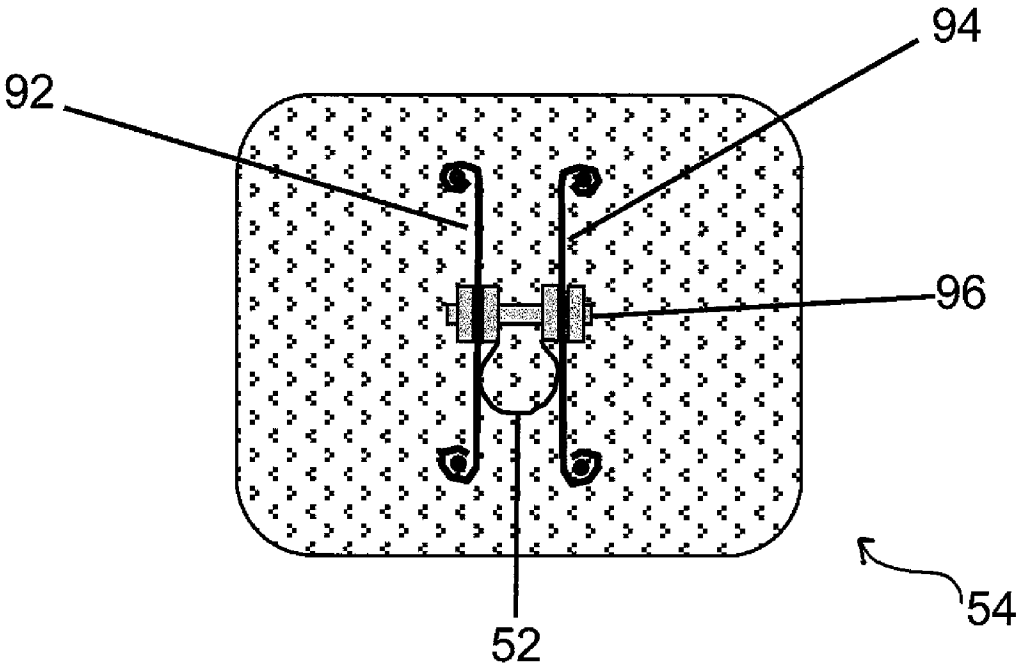
FIG. 8 is a drawing which illustrates a bottom view of a seat with post clamp according to an embodiment of the present invention.
Figure 13:
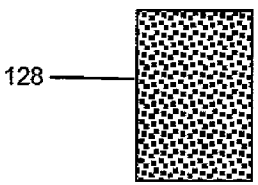
FIG. 13 is a drawing which illustrates foam padding in the chest/shoulder strap of a carrier according to an embodiment of the present invention.

FIG. 6 illustrates an embodiment of chest and shoulder strap assembly 41. In this embodiment, fabric 66 can optionally have padding 128 (see FIG. 13) there to or therein. The padding 128, can include a foam material having a thickness of about ⅜". In this embodiment, fabric 66 is preferably folded over and sewn on the sides to create pocket that slides over the top of frame 56. As best illustrated in FIG. 8, straps 16, 44, and 94 are optionally formed from a polymeric webbed material, including but not limited to nylon, polypropylene and/or polyester webbing and most preferably comprise a width of from about ⅜" to about 2" and most preferably about ¾". Strap 94 is preferably folded over on itself with loop 96 that is large enough for carabineer, clip, and/or other fastener 62 to connect to. Straps 16 and 44 are preferably sewn and/or formed such that they bulge out to provide a handle to hold onto. Optionally padding can be added on shoulder straps 16 and 44, though it is not required because the load is primarily distributed over the hips of the carrier.

Figure 7:
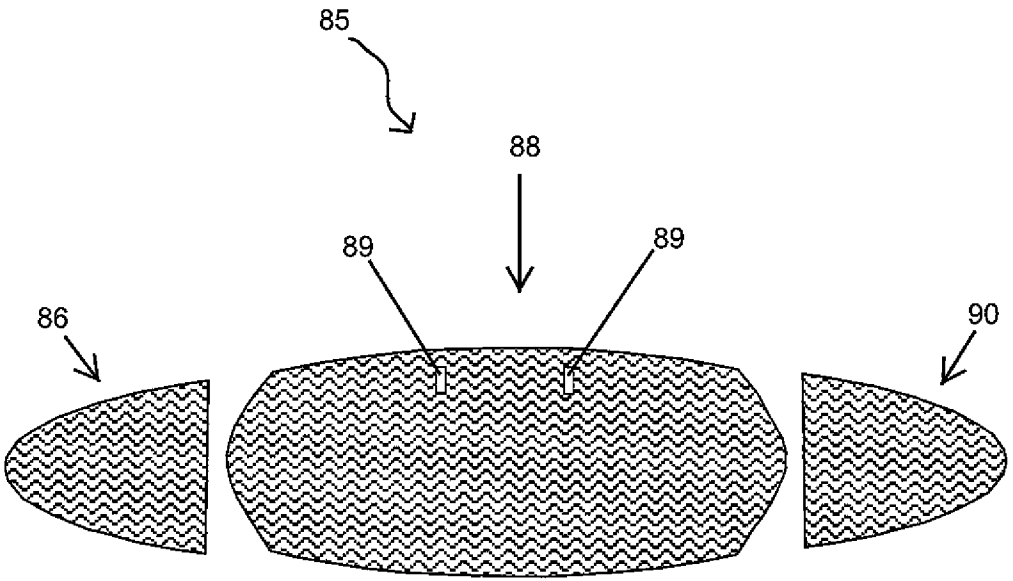
FIG. 7 is a drawing which illustrates a view of the waistband stiffener according to an embodiment of the present invention.

As best illustrated in FIG. 7, waistband reinforcing 85 can optionally be formed from a plastic and/or metal material and can be disposed within or on waistband 24 such that forces exerted by waist strap 26 are distributed over a wider area of the carrier's body. Optionally, reinforcing 85 can be formed from a plastic material and can have a thickness of from about 0.010" to about 0.25" and most preferably comprises a thickness of about 0.030". Optionally, waistband reinforcing 85 can be formed from a single continuous piece of material, or it can be formed from a plurality of pieces of material. For example, in one embodiment, waistband reinforcing 85 can be formed into end pieces 86 and 90, as well as central section 88. In one embodiment, central section 88 can have a thickness different than that of end pieces 86 and 90. In one embodiment, central section 88 preferably comprises a thickness of from about 0.010" to about 0.25" and most preferably comprises a thickness of about 0.062". Optionally, end pieces 86 and 90 can be disposed on an inner circumference of waistband 24 on an inside diameter of any padding 97 which may be used. Optionally, central section 88 can be fastened into one or more slots in waistband 24. Reinforcing 85 and/or central section 88 preferably also provides a backing to frame 56 (see FIGS. 5A and B), thus also distributing forces applied by frame 56 across a wider portion of a carrier's body. Optionally, any type of rigid and/or substantially rigid material can be used to form reinforcing 85, including but not limited to a metal, a plastic material, a composite material, combinations thereof and the like. Waistband 24 with padding 97, and reinforcing 85 preferably provides for comfortable load transfer from frame 56 and waist strap 26 to the carrier's waistband and/or hips. In one embodiment, the present invention comprises a single frame and seat post and does not comprise additional elongated support members that are rigid or metallic.

FIG. 8 illustrates a typical noseless saddle bike seat 54 with mounting brackets 52, 92, 94 and 96. In one embodiment, seat 54 can optionally be used as the seat of the present invention.

Figure 9:
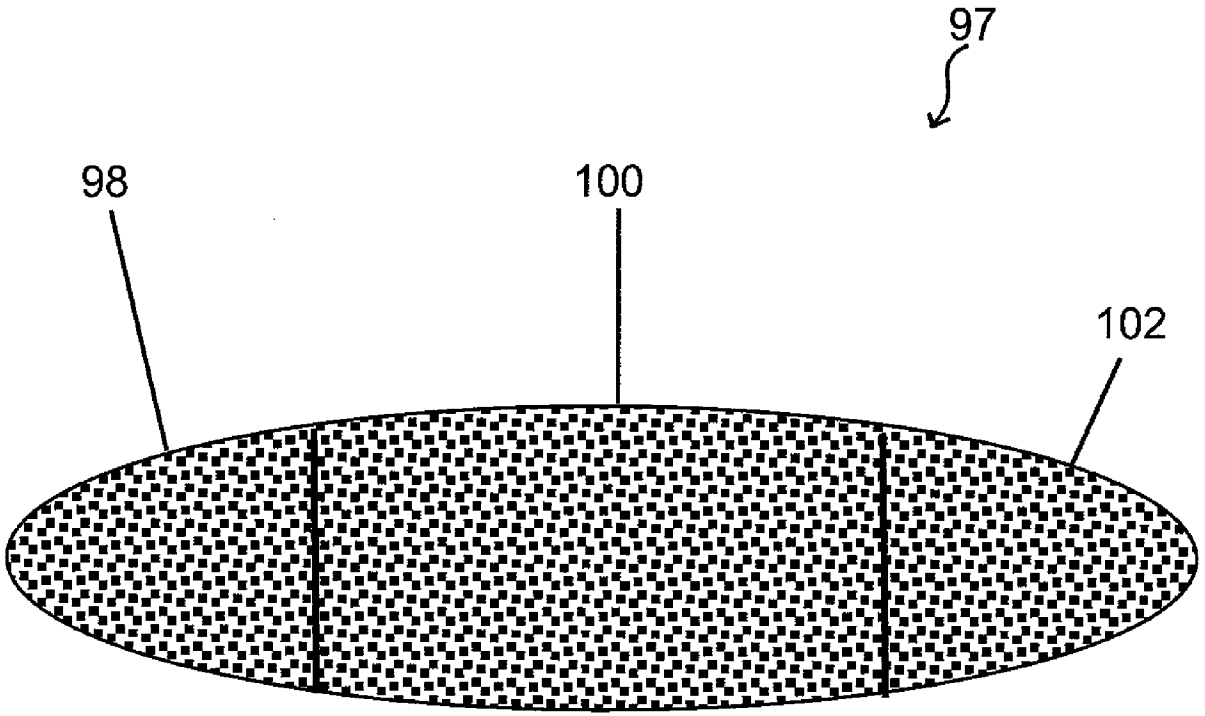
FIG. 9 is a drawing which illustrates waistband foam padding according to an embodiment of the present invention.

Referring now to FIG. 9, padding 97 can optionally be disposed within and/or on waistband 24 (see FIG. 1). Optionally, padding 97 can be formed from a foam material having open or closed cells. While various thicknesses can be selected for padding 97, padding 97 most preferably comprises a thickness of from about ¼" to about 1.5" and most preferably comprises a thickness of about ¾". Padding 97 can be formed into a single, undivided piece of material, or it can optionally be formed from a plurality of pieces of material, for example padding pieces 98, 100, and 102. Optionally, separate padding pieces can assist waistband 24 in folding, flexing, and/or bending. Waistband 24 can optionally be sewn with one, two, or more openings in the back, for example near the locations of the end portions of each of padding pieces 98, 100, and 102 such that the padding pieces can be inserted and/or made removably positionable within waistband 24.

Figure 10:
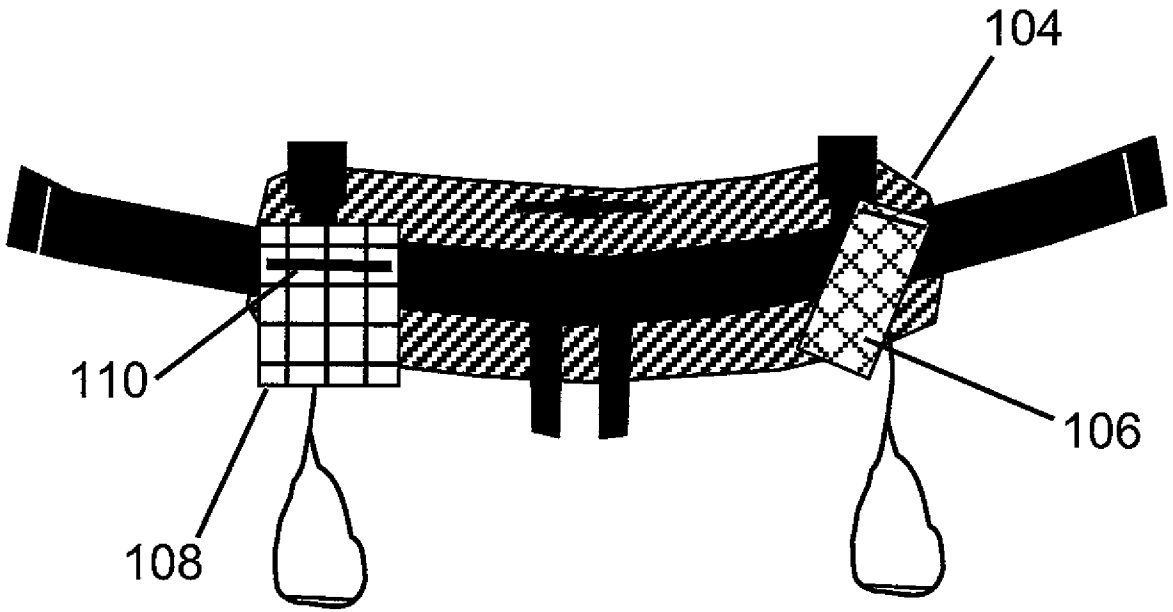
FIG. 10 is a drawing which illustrates a rear view of a waistband with pocket and drink holder according to an embodiment of the present invention.
Figure 11:
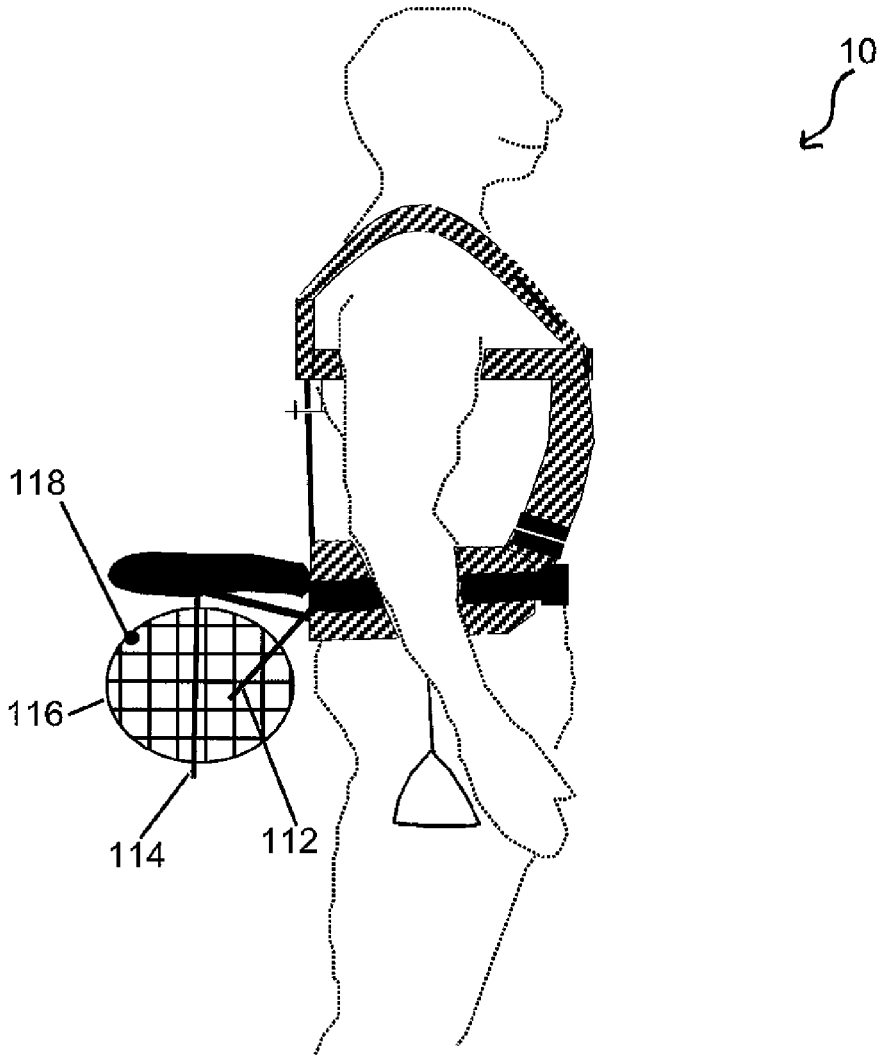
FIG. 11 is a drawing which illustrates a side view of a carrier with an under seat storage bag according to an embodiment of the present invention which is disposed on a person.
Figure 12:
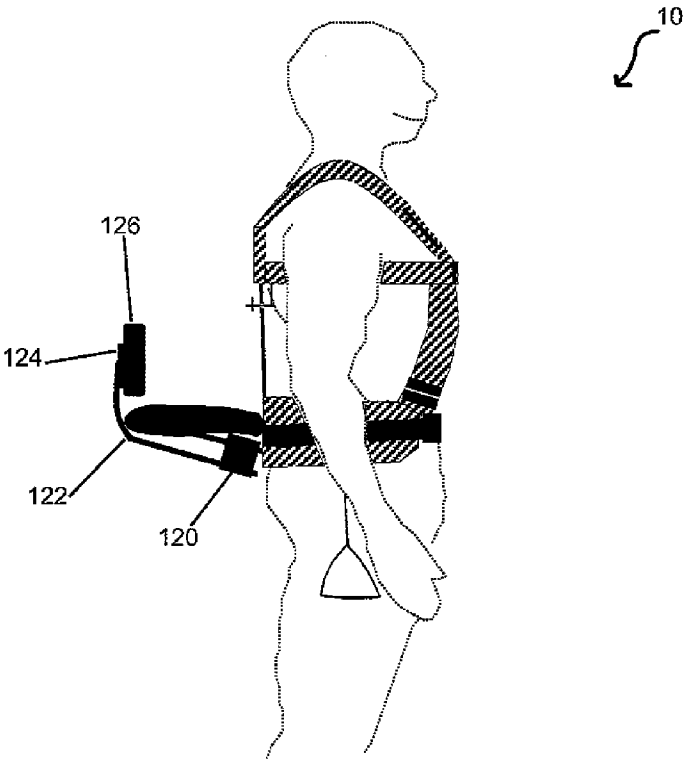
FIG. 12 is a drawing which illustrates a side view of a carrier having a backrest disposed thereon according to an embodiment of the present invention which is disposed on a person.

FIG. 10 illustrates a pocket 108 with zipper 110 and drink holder 106 with elastic 104. FIG. 11 illustrates storage bag 116 with mounting straps 112, 114 and zipper 118. FIG. 12 illustrates a back rest 126 with mounting brackets 120, and 124 and mounting bar 122.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A human transport apparatus for a human carrier comprising:

two shoulder straps;

at least one chest strap encircling the human carrier's chest;

at least one waistband positionable on top of the human carrier's hips; and an at least substantially rigid frame attachable to said waistband;

said frame and said waistband configured such that at least a majority of weight of a rider is distributed about the carrier's hips and not on one or more shoulders of the carrier;

said frame extending vertically from said waistband to at least said chest strap, said chest strap holding said frame to said carrier;

a seat for the rider attachable to said frame;

a back rest on a mounting post; and said frame connected to said shoulder straps.

2. The apparatus of claim 1 further comprising stirrups on said waistband for the rider.

3. The apparatus of claim 1 further comprising at least one handle on said shoulder straps for the rider.

4. The apparatus of claim 1 further comprising padding disposed in a location selected from a location consisting of on said waistband, in said waistband, and a combination thereof.

5. The apparatus of claim 1 wherein said frame attaches to said waistband via straps.

6. The apparatus of claim 1 wherein said mounting post is attached to a mounting bracket which itself is attached to a seat post.

7. The apparatus of claim 6 further comprising padding disposed in said at least one chest strap.

8. The apparatus of claim 1 further comprising padding disposed on or in said shoulder straps.

9. The apparatus of claim 1 further comprising a plurality of disassembly points.

10. The apparatus of claim 9 wherein said disassembly points are formed at least partially from an element selected from a list consisting of a carabineer, a clip, a clamp, and a combination thereof.

11. The apparatus of claim 1 further comprising a pocket.

12. The apparatus of claim 1 further comprising a rider retaining strap.

13. The apparatus of claim 1 further comprising a seat post which is removably positionable with respect to said at least substantially rigid frame.

14. The apparatus of claim 1 further comprising a storage compartment.

* * * * *